US010548453B2

(12) United States Patent
Metzel et al.

(10) Patent No.: US 10,548,453 B2
(45) Date of Patent: Feb. 4, 2020

(54) FLOOR MOP

(71) Applicant: Freudenberg Household Products LP, Aurora, IL (US)

(72) Inventors: Doug Metzel, Berwyn, IL (US); Eric Wehrli, Oswego, IL (US); Scott Munro, Aurora, IL (US)

(73) Assignee: Freudenberg Household Products LP, Aurora, IL (US)

( * ) Notice: Subject to any disclaimer, the term of this patent is extended or adjusted under 35 U.S.C. 154(b) by 130 days.

(21) Appl. No.: 15/793,568

(22) Filed: Oct. 25, 2017

(65) Prior Publication Data

US 2018/0042444 A1 Feb. 15, 2018

Related U.S. Application Data

(63) Continuation-in-part of application No. 29/548,417, filed on Dec. 14, 2015, now Pat. No. Des. 806,338.

(51) Int. Cl.

| | |
|---|---|
| ***A47L 13/22*** | (2006.01) |
| ***A47L 13/254*** | (2006.01) |
| ***A47L 13/256*** | (2006.01) |

(52) U.S. Cl.

CPC ..... *A47L 13/256* (2013.01); *A47L 13/22* (2013.01); *A47L 13/254* (2013.01)

(58) Field of Classification Search

CPC ..... A47L 13/22; A47L 13/254; A47L 13/256; A47L 13/257; A47L 13/258

USPC ..... 15/228

See application file for complete search history.

(56) References Cited

U.S. PATENT DOCUMENTS

| | | | | |
|---|---|---|---|---|
| D428,226 | S | | 7/2000 | Kunkler |
| D458,427 | S | | 6/2002 | Kunkler et al. |
| D487,174 | S | | 2/2004 | Colman et al. |
| D515,759 | S | | 2/2006 | Fischer |
| D544,668 | S | | 6/2007 | Harper et al. |
| D549,414 | S | | 8/2007 | Van Landingham, Jr. |
| D591,921 | S | | 5/2009 | Rosenzweig et al. |
| D597,269 | S | | 7/2009 | McNeil et al. |
| D599,517 | S | | 9/2009 | Vrdoljak |
| D602,218 | S | | 10/2009 | Koenig et al. |
| D657,928 | S | | 4/2012 | Byrne |
| D659,924 | S | | 5/2012 | McGee et al. |
| D661,035 | S | | 5/2012 | McGee et al. |
| D672,107 | S | | 12/2012 | Van Landingham, Jr. et al. |
| D673,337 | S | | 12/2012 | Chow |
| D673,748 | S | * | 1/2013 | Snyder ..... D32/45 |
| D685,966 | S | | 7/2013 | Houghton |

(Continued)

FOREIGN PATENT DOCUMENTS

AT 4321/2000-0001 1/2001

OTHER PUBLICATIONS

Amazon.com—HAAN SS-22A Multiforce Plus, oldest review 2016, https://www.amazon.com/HAAN-SS-22A-Multiforce-Certified-Refurbished/dp/B01OTRP6EI/ref=sr_1_85?ie=UTF8&qid=1488759593&sr=8-85&keywords=mop+head, site visited Mar. 5, 2017.

*Primary Examiner* — Randall E Chin

(74) *Attorney, Agent, or Firm* — Leydig, Voit & Mayer, Ltd.

(57) ABSTRACT

A floor mop includes a handle, a shaft coupled to the handle, and a plate attached to the shaft opposite the handle. The plate has a thickness that is minimum in a central portion adjacent an attachment to the shaft and increases in a lateral direction away from the central portion, the plate adapted to accommodate a cleaning pad thereon.

18 Claims, 8 Drawing Sheets

(56) References Cited

U.S. PATENT DOCUMENTS

| | | | | |
|---|---|---|---|---|
| D699,011 | S | 2/2014 | deBlois | |
| D747,054 | S | 1/2016 | Seifts et al. | |
| D766,527 | S * | 9/2016 | Niedzwecki | D32/45 |
| 2002/0166573 | A1 | 11/2002 | Policicchio et al. | |
| 2003/0074756 | A1* | 4/2003 | Policicchio | A47L 13/16 15/228 |
| 2006/0048318 | A1* | 3/2006 | Goh | A47L 11/12 15/97.1 |
| 2011/0158740 | A1 | 6/2011 | Kandasamy et al. | |
| 2013/0160228 | A1 | 6/2013 | Kaminer et al. | |
| 2015/0089757 | A1* | 4/2015 | Davidshofer | A47L 13/254 15/147.2 |
| 2015/0128371 | A1 | 5/2015 | Zorzo | |
| 2016/0345794 | A1 | 12/2016 | Zhu et al. | |

* cited by examiner

FLOOR MOP

CROSS-REFERENCE TO RELATED APPLICATIONS

This application is a continuation-in-part of U.S. Design patent application Ser. No. 29/548,417, which was filed on Dec. 14, 2015, which is incorporated herein by reference.

FIELD OF THE DISCLOSURE

The present disclosure relates to spray mops and similar devices.

BACKGROUND OF THE INVENTION

The device under consideration relates to a floor sweeper or mop. The mop may be used dry or in conjunction with a liquid or spray material that aids cleaning with the mop. Spray mops are typically constructed with a flat plate, upon which a cover is disposed. The cover may be formed of a synthetic or natural fabric or the like, or combinations thereof. The cover both provides scrubbing action on a surface to be cleaned and absorbent and/or attractive qualities to pick up and retain both solids and liquids.

The plate of the mop is typically attached at a central portion thereof to a shaft and handle via a universal or multidirectional joint that provides freedom of movement in multiple directions between the shaft and the plate such that a user can easily direct the mop plate along a desired path. Because the shaft is attached to the plate at a central portion thereof, the downforce exerted by the user and the weight of the device tends to be greatest in the center of the plate and relatively less in areas of the plate that are radially peripheral relative to the center of the plate.

SUMMARY OF THE DISCLOSURE

In one aspect, the disclosure describes a floor mop. The floor mop includes a handle, a shaft coupled to the handle, a multidirectional joint coupled to the shaft opposite the handle, and a plate attached to the multidirectional joint. The plate includes a center element attached to and adjacent the multidirectional joint, a border element defining an outer periphery of the plate, and an interconnected web of web members connecting the center element and the border element.

In another aspect, the disclosure describes a floor mop. The floor mop includes a handle, a shaft coupled to the handle, and a plate attached to the shaft opposite the handle. The plate has a thickness that is minimum in a central portion adjacent an attachment to the shaft and increases in a lateral direction away from the central portion, the plate adapted to accommodate a cleaning pad thereon.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration as used herein refer to a specified structural size and shape.

The invention is directed to a spray mop. The spray mop has a structure suitable for use as either a wet mop or a dry mop. When used as a wet mop, the spray mop is able to project a fluid, such as a cleaning solution, in front of the mop and onto a surface for cleaning. The spray mop can then be guided over the surface by the user to clean the surface.

Figure 9:
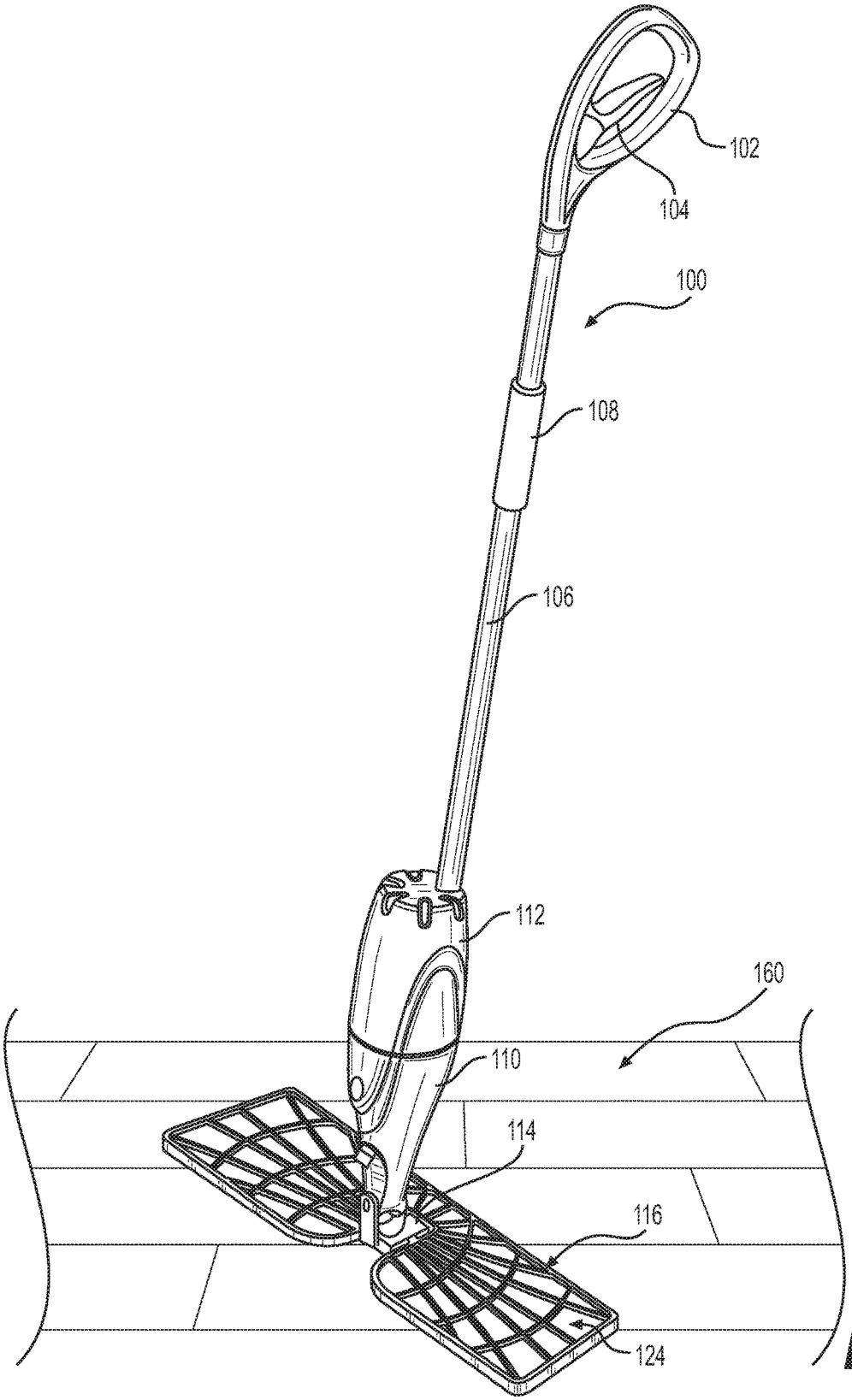
FIG. 9 is a perspective view of a spray mop according to one embodiment of the disclosure with the cleaning end in an inverted position with the top surface of the cleaning end disposed in contact with a surface to be cleaned.

Referring to FIGS. 1-9, the spray mop 100 can include a handle 102, a trigger 104, an external shaft 106, a grip 108, a spray housing 110, a bottle 112, a multidirectional joint 114, and a cleaning end 116. The handle 102, which is disposed at or near the proximal end of the mop 100, can be used to grip and guide the spray mop 100 in a desired direction. The trigger 104, which is disposed in the handle 102, can be used to actuate a pump mechanism to activate the spray. The grip 108 can be coupled to the external shaft 106 to provide a secondary handhold. The spray housing 110 retains the bottle 112 and connects the external shaft 106 to the cleaning end 116. The bottle 112 is filled with a fluid for cleaning a surface, such as a floor 160 (FIG. 9). The bottle 112 is reusable and is removably mounted to the spray housing 110 so that it can be filled with a cleaning fluid. Fluid in the bottle 112 is communicated to a pump mechanism, which draws fluid from the bottle 112 and provides a pressurized fluid flow to a spray nozzle 120. The spray nozzle 120 sprays the fluid onto the floor. The multidirectional joint 114 provides freedom of movement in multiple directions between the spray housing 110 and the cleaning end 116 such that a user can easily direct and steer the cleaning end 116 along a desired path.

The spray housing 110 includes the nozzle 120 on its front surface. The nozzle 120 is generally directed forward and downward so that fluid exiting the nozzle 120 is sprayed onto a surface in front of the cleaning end 116 of the spray mop 100.

The cleaning end 116 includes a plate frame 122 that is attached to the multidirectional joint 114. The multidirectional joint 114 is configured to permit the plate frame 122 to pivot such that either a lower face 124 or an upper face 126 of the plate is oriented to face the surface to be cleaned.

As discussed further below, the cleaning end 116 is sized and shaped to receive a cleaning pad 118 (FIG. 8) as is well known. The cleaning pad 118 can be any suitable type for any suitable surface to be cleaned, such as disposable or reusable cleaning pads or coverings (such as microfiber pads). The pad 118 may be made of synthetic or natural materials or combinations thereof. The cleaning pad 118 may be shaped by two layers of fabric. Each layer of fabric may have an outer, cleaning side and an inner side. The layers are placed adjacent one another with their inner sides in facing relation, and are attached to one another along at least three sides around their perimeter. The fourth side is left at least partially unattached to form an internal pocket. When the pad 118 is attached to the cleaning end 116 of the mop, the cleaning end pad, deck or plate 122 is placed in the pocket to retain the pad thereon. The pad or plate 122 can be flipped to expose either of the two cleaning sides to the floor.

The configuration of the plate 122 will now be set out in detail. The plate 122 is a framework connected to the multidirectional joint 114, such that the cleaning end 116 is permitted to pivot and move as noted above.

Figure 6:
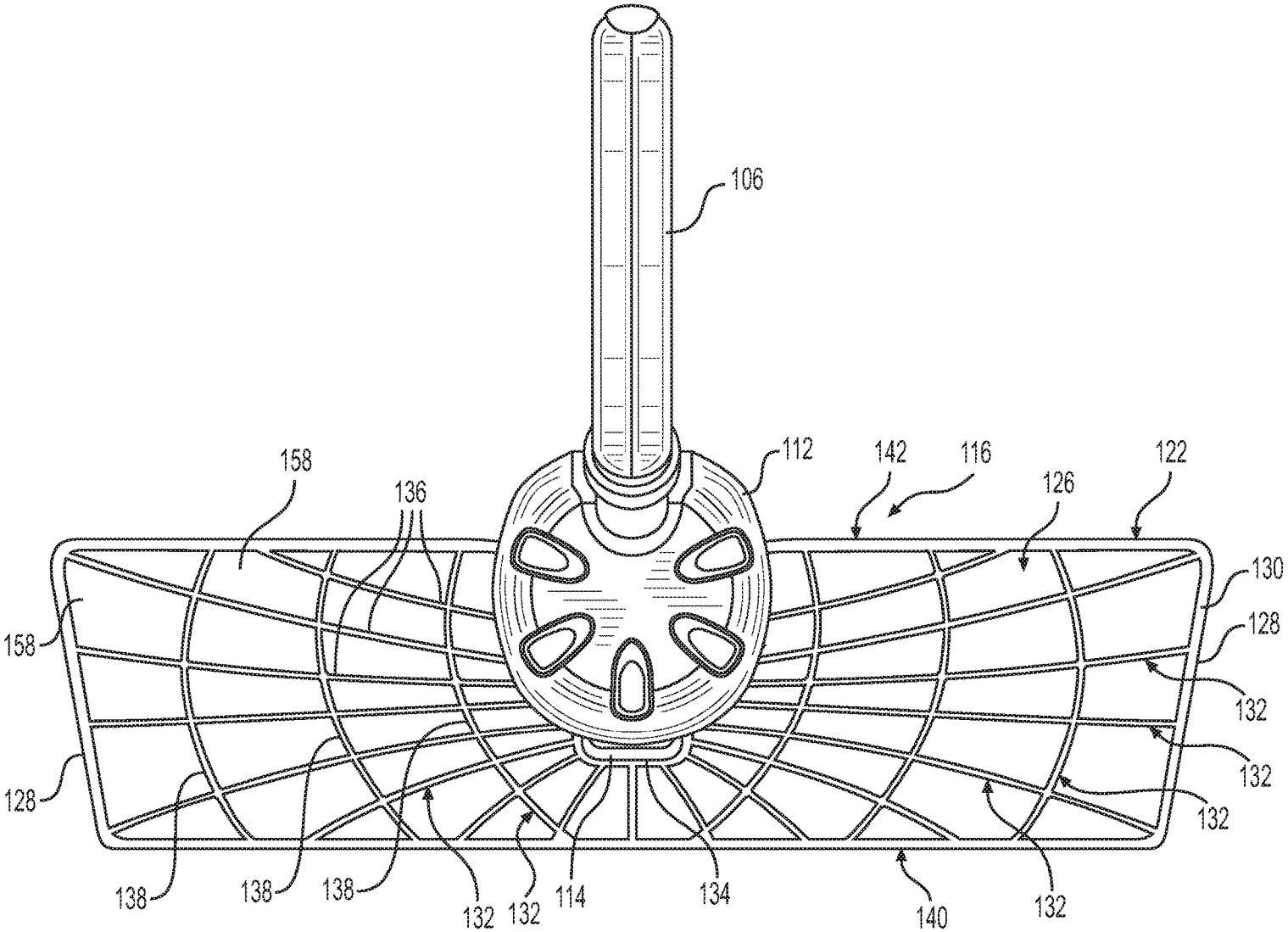
FIG. 6 is a top view of the cleaning end of a spray mop according to an embodiment of the disclosure.
Figure 7:
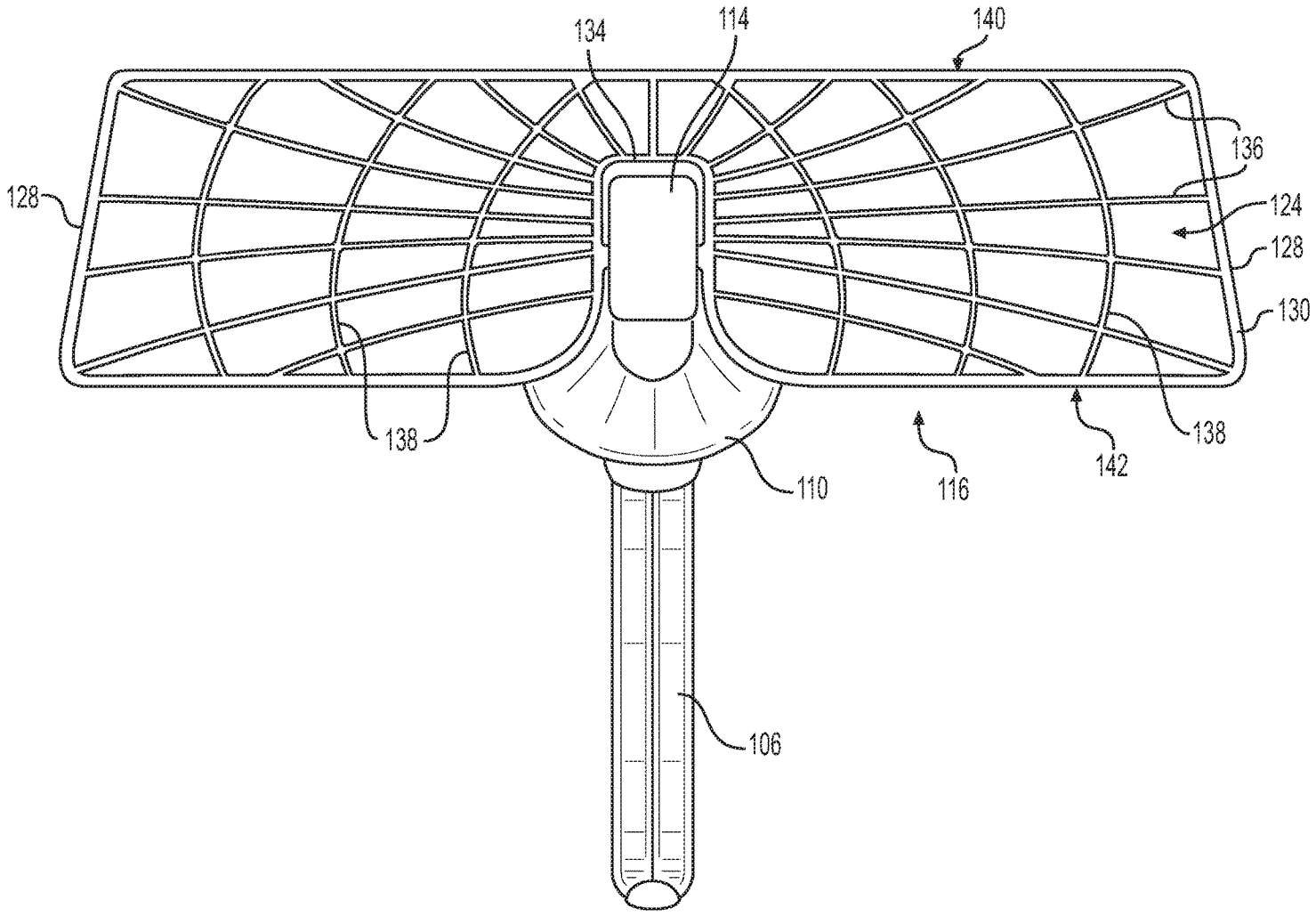
FIG. 7 is a bottom view of the cleaning end of shown in FIG. 6.
Figure 8:
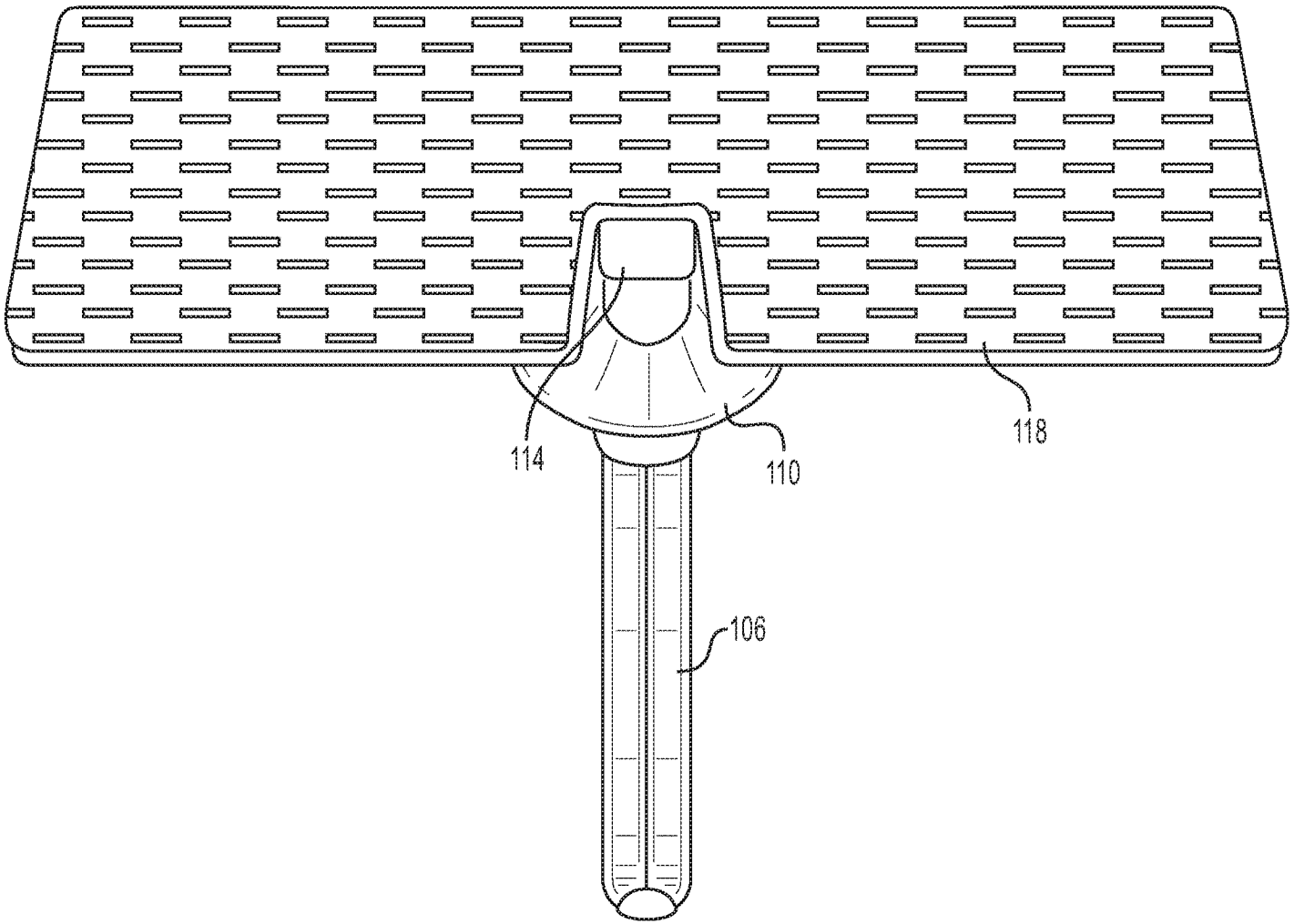
FIG. 8 is a bottom view of the cleaning end shown in FIG. 7 with a cleaning pad disposed on the cleaning end.

The plate 122, referring to FIGS. 6 and 7, is shaped generally as a plate having upper and lower faces, front and rear faces, and side faces. The upper and lower faces may be generally trapezoid in shape with the narrower width side oriented towards the front or rear of the mop, depending on the orientation of the plate 122, i.e., depending on whether the upper surface 126 is oriented upwardly toward the handle or downwardly away from the handle. However, the plate 122 may have other suitable shapes such as rectangular, square or and any suitable non-quadrilateral shapes, triangular, round, elliptical and the like.

Figure 1:
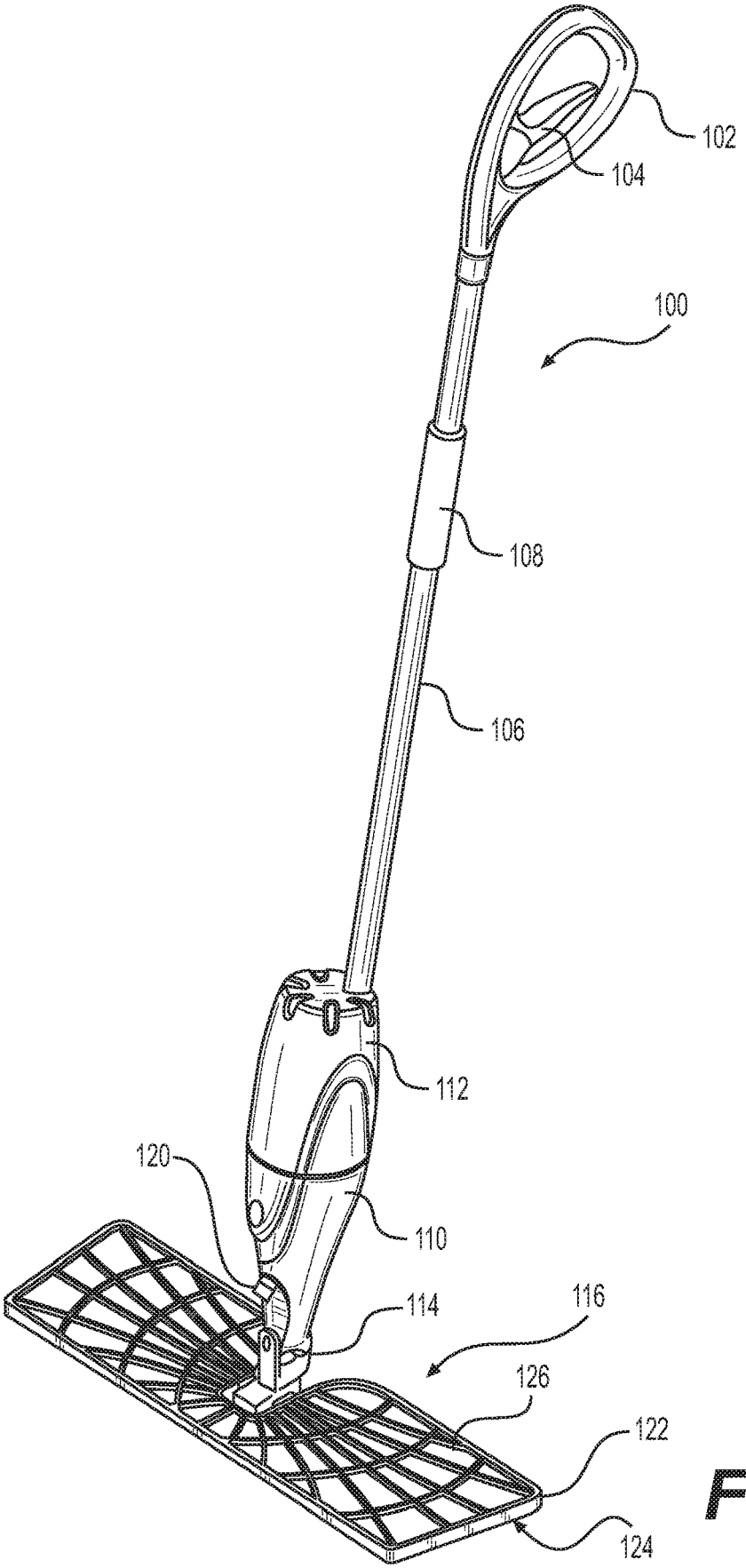
FIG. 1 is a perspective view of a spray mop according to one embodiment of the disclosure.
Figures 2, 3:
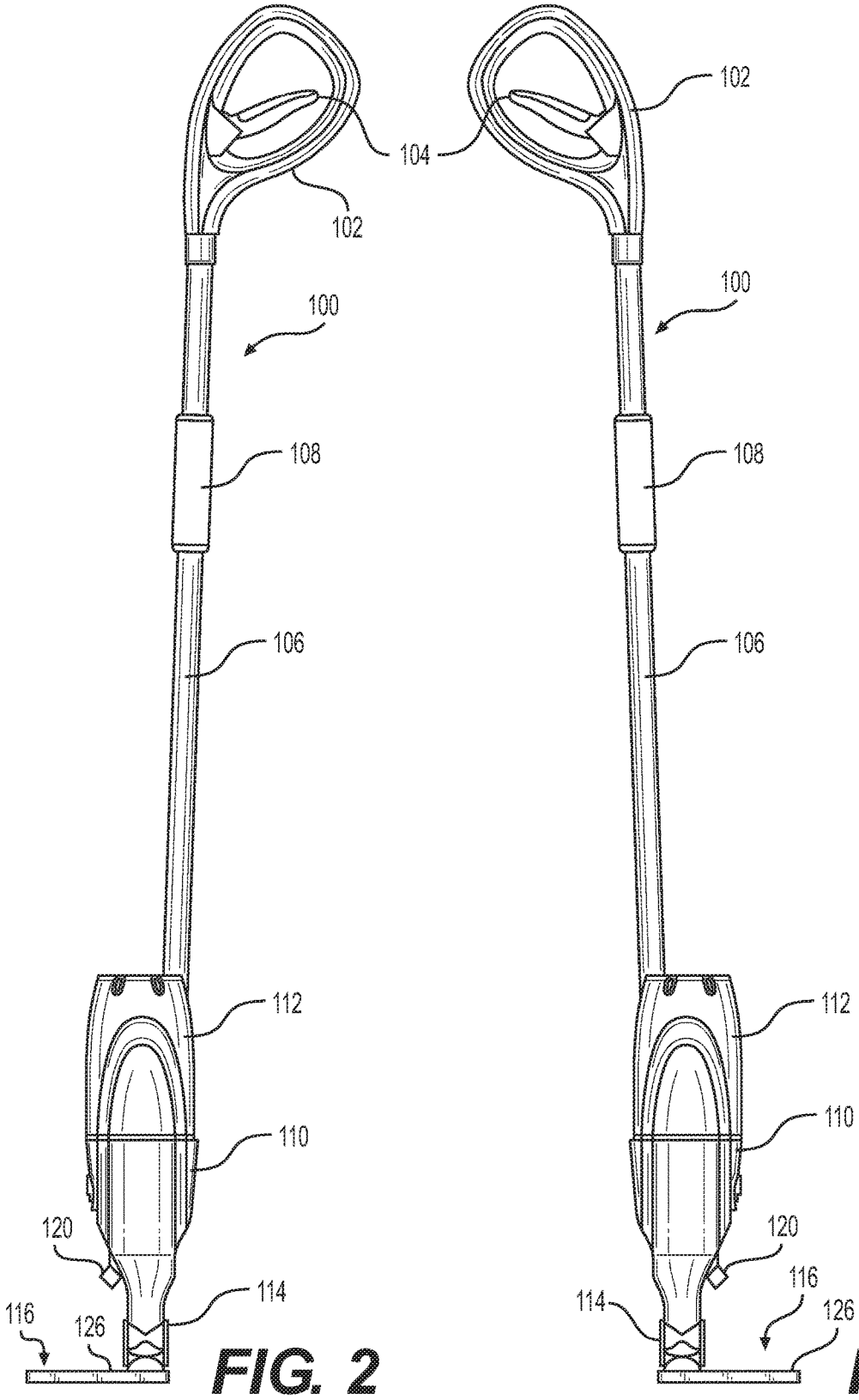
FIG. 2 is a right side view of the spray mop of FIG. 1.
FIG. 3 is a left side view of the spray mop of FIG. 1.
Figure 4:
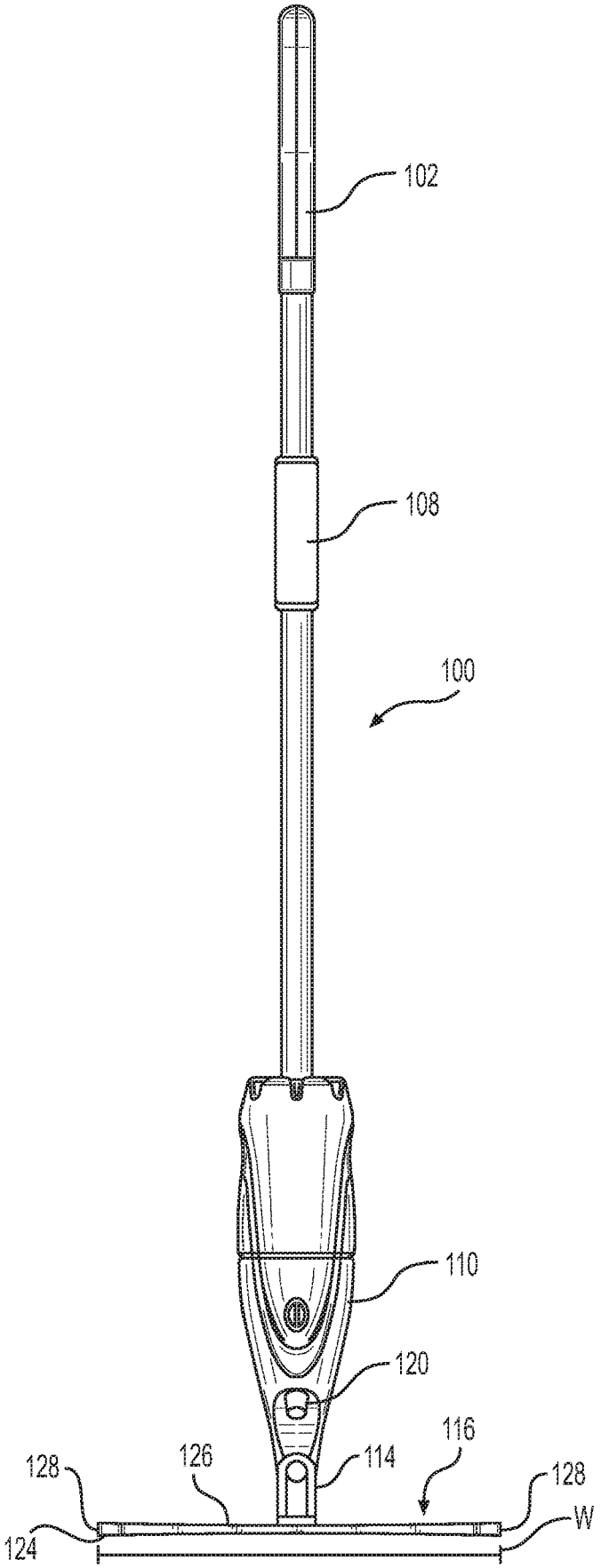
FIG. 4 is a rear view of the spray mop of FIG. 1.
Figure 5:
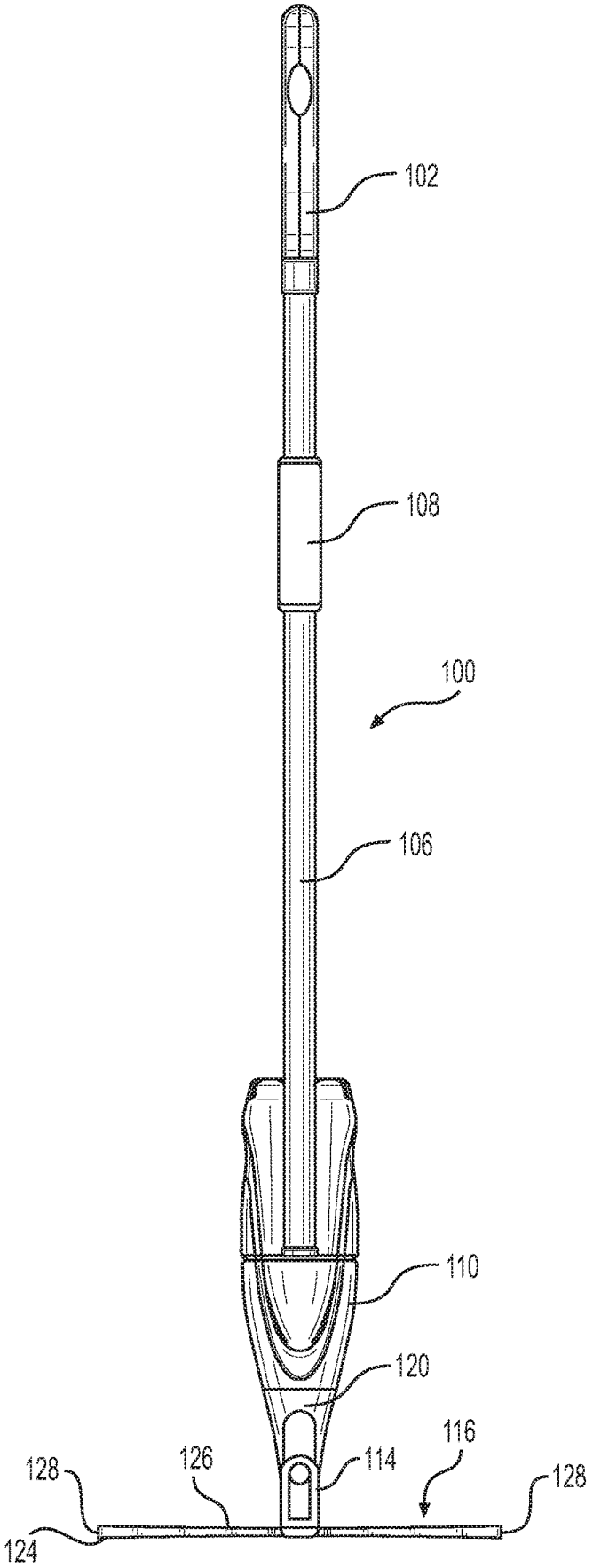
FIG. 5 is a front view of the spray mop of FIG. 1.

The plate 122 includes a generally planar horizontal configuration, when viewed as shown in at least FIGS. 4 and 5. The plate 122 may include an upper surface 126 that is U-shaped across the width W of the plate (i.e., the long axis of the plate) as shown in FIG. 4. The plate 122 may include an upper surface 126 that is concave such that at least the lateral outer side edges 128 thereof have a higher elevation than the center of the plate, referring to the depiction of the device as in FIG. 4, for example. The concavity may be only defined laterally across the width W of the plate 122 from side to side or the concavity may be both from side to side and the front to the back of the plate. In other words, the plate 122 may have a thickness that is minimum around the center of the plate 122, where the connection 114 is disposed, and increases in both directions towards the lateral sides of the plate 122.

The plate 122 includes a lower surface 124, on the face opposite of the upper surface 126 of the plate, that is the mirror of the upper surface, in that the lower surface has an inverse U-shaped or a concave surface, wherein the center of the lower surface has a higher elevation than the lateral outer side edges 128. Since the shaft 106 terminates at joint 114 in the center of the plate 122, the act of pressing down on the handle 102 causes the downward facing face to flatten out (if the plate is flexible) and downward force to be exerted on the center of the plate 122. Because of the concave shape of the surface (124 or 126) that is positioned in contact with the surface to be cleaned, i.e., the acting surface, the downward force tends to be higher on the surface at the radially outward periphery of the plate 122 and more particularly at the outer side edges 128. This is a significant improvement over prior art embodiments, where the down force tends to be concentrated in the center of the cleaning end and insufficient or a lesser reaction force from the floor is applied along the outer portions of the plate 122.

The plate 122 includes a framework with a border element 130 that is disposed about the peripheral boundary of the plate 122 and defines the outer boundary or edge of the plate. The border element 130 may be a continuous, uninterrupted band or strip of material that forms a vertical wall of varying height when the plate 122 is lying flat on the floor. The plate 122 also includes a plurality of web members 132 that interconnect the center element 134 to the border element 130. The web members 132 are separate strips of material that are spaced apart by voids 158 in the plate. In other words, the web members 132 are discrete, individual lengths of material that define voids therebetween. The web members 132 are attached to each other where they intersect and where they terminate at one or both of the border element and the center element. The center element 134 surrounds and is attached to the joint 114.

The web members 132 include two sub-types of web members. The web members 132 include a set of radially extending web members 136 that interconnect the center element 134 to the border element 130. Each of the radially extending web members 136 extend radially from the center element to the border element 130 in an arrangement like wheel spokes. The web members 132 include a set of concentric circular web members 138. The concentric circular web members 138 are concentrically disposed about the center element 134 and interconnect a front portion 140 of the border element 130 to a rear portion 142 of the border element. Where the radially extending web members 136 intersect the concentric circular web members 138 the web members 132 interconnect with each other, so as to form an interconnected web structure.

The web members 132 may be made of any suitable material, such as plastic, metal, and composite materials. The web members 132 may be configured to provide a selected amount of resilience or compliance such that the plate 122 conforms to the surface being cleaned. This capability also permits the plate 122 to flex and urges the outer edges 128 against the surface to be cleaned, thus enhancing the cleaning function of the mop 100. Also, the ability to flex enhances the ability of the mop 100 to accommodate to non-smooth floors, such as tile and stone, for example. In other embodiments, the plate 122 is relatively rigid, which enhances the effectiveness of transferring the downforce applied through the shaft 106 to the outer edges 128. The web members 132 also have the effect of reducing weight of the plate 122 by virtue of the presence of the voids 158 defined therebetween. The configuration of the web members 132 are adaptable to any "flip-mop" or "flat mop" device.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A floor mop, comprising:

a handle;

a shaft coupled to the handle;

a multidirectional joint coupled to the shaft opposite the handle; and a plate attached to the multidirectional joint, the plate including a center element attached to and adjacent the multidirectional joint, a border element defining an outer periphery of the plate, and an interconnected web of web members connecting the center element and the border element;

wherein the plate has a lower face and an upper face opposite the lower face, wherein both the lower face and upper face include a U-shape defined laterally across a width of the plate.

2. The floor mop of claim 1, wherein the plate is trapezoidal.

3. The floor mop of claim 1, wherein the lower face and upper face includes a concave shape.

4. The floor mop of claim 3, including first and second outer side edges at opposite sides of the plate, wherein the concave shape is defined by curvature of the plate from the first outer side edge to the second outer side edge.

5. The floor mop of claim 4, wherein the concave shape is further defined by curvature of the plate from a front edge to a rear edge of the plate.

6. The floor mop of claim 1, wherein the web members are made of one or more of plastic, metal, and composite materials.

7. The floor mop of claim 1, wherein the web members include a plurality of radially extending web members that extend between and interconnect the center element and the border element.

8. The floor mop of claim 1, wherein the web members include a plurality of concentric circular web members.

9. The floor mop of claim 1, wherein the web members include a plurality of radially extending web members that extend between and interconnect the center element and the border element and a plurality of concentric circular web members that form the interconnected web of web members.

10. The floor mop of claim 9, wherein the web members are interconnected where individual ones of the plurality of radially extending web members intersect individual ones of the plurality of concentric circular web members.

11. The floor mop of claim 10, wherein the web members are resilient and permit the plate to flex.

12. The floor mop of claim 1, wherein the web members define voids in the plate.

13. A floor mop, comprising:

a handle;

a shaft coupled to the handle; and a plate attached to the shaft opposite the handle, the plate having a thickness that is minimum in a central portion adjacent an attachment to the shaft, and increases in a lateral direction away from the central portion, the plate adapted to accommodate a cleaning pad thereon;

wherein the plate further comprises a center element attached to and adjacent the attachment to the shaft, a border element defining an outer periphery of the plate, and an interconnected web of web members connecting the center element and the border element.

14. The floor mop of claim 13, wherein the plate is trapezoidal.

15. The floor mop of claim 13, wherein the plate has a lower face and an upper face opposite the lower face, and wherein each of the lower and upper faces has a U-shape defined laterally across a width of the plate.

16. The floor mop of claim 15, wherein each of the lower and upper faces has a concave shape.

17. The floor mop of claim 13, wherein the web members include a plurality of radially extending web members that extend between and interconnect the center element and the border element.

18. The floor mop of claim 13, wherein the web members include a plurality of concentric circular web members.

* * * * *